United States Patent [19]

Madgavkar et al.

[11] Patent Number: 4,790,930

[45] Date of Patent: Dec. 13, 1988

[54] TWO-STEP HETEROCYCLIC NITROGEN EXTRACTION FROM PETROLEUM OILS

[75] Inventors: Ajay M. Madgavkar, Katy, Tex.; Don M. Washecheck, Naperville, Ill.

[73] Assignee: Shell Oil Company, Houston, Tex.

[21] Appl. No.: 55,479

[22] Filed: May 29, 1987

[51] Int. Cl.[4] ..... C10G 17/04; C10G 21/06

[52] U.S. Cl. ..... 208/254 R; 208/87; 208/90; 208/117; 208/263; 208/265

[58] Field of Search ..... 208/254 R

[56] References Cited

U.S. PATENT DOCUMENTS

| | | | |
|---|---|---|---|
| 1,686,136 | 10/1928 | Ihrig | 260/269 |
| 2,263,175 | 11/1941 | Lazar et al. | 260/269 |
| 2,263,176 | 11/1941 | Lazar et al. | 208/254 R |
| 2,352,236 | 6/1944 | Thomas | 196/39 |
| 2,518,353 | 8/1950 | McKinnins | 208/254 |
| 2,662,843 | 12/1953 | Castner | 208/282 |
| 2,800,427 | 7/1957 | Junk et al. | 208/254 R |
| 3,023,160 | 2/1962 | Stedman | 208/254 R |
| 3,551,324 | 12/1970 | Lillard | 208/14 |
| 3,719,587 | 3/1973 | Karchmer et al. | 208/254 R |
| 4,209,385 | 6/1980 | Stover | 208/254 R |
| 4,271,009 | 6/1981 | Stover et al. | 208/282 |
| 4,272,361 | 6/1981 | Compton | 208/282 |
| 4,332,675 | 6/1982 | Baset | 208/254 |
| 4,332,676 | 6/1982 | Baset | 208/254 |
| 4,392,948 | 7/1983 | Debande | 208/254 R |
| 4,409,092 | 10/1983 | Johnson et al. | 208/89 |
| 4,426,280 | 1/1984 | Chen et al. | 208/254 R |
| 4,483,763 | 11/1984 | Kuk et al. | 208/254 R |
| 4,534,096 | 9/1985 | Rudnick | 208/254 R |
| 4,605,484 | 8/1986 | Madgavkar | 208/282 |
| 4,623,444 | 11/1986 | Che et al. | 208/254 R |
| 4,671,865 | 6/1987 | Madgavkar | 208/96 |

*Primary Examiner*—H. M. S. Sneed
*Assistant Examiner*—Helane Myers

[57] ABSTRACT

A process is disclosed for the removal of basic heterocyclic nitrogen compounds from a petroleum crude oil or fraction thereof which comprises first treating the petroleum crude oil or fraction thereof rich in basic heterocyclic nitrogen compounds in a two-phase extraction zone with an extractant consisting essentially of an aqueous solution of a lower carboxylic acid, preferably having between 1 and 15 carbon atoms. The extractant complexes the basic heterocyclic nitrogen compounds to produce a stream of petroleum crude oil or fraction thereof having a smaller content of heterocyclic nitrogen compounds and a stream comprising the lower carboxylic acid extractant with an increased quantity of basic heterocyclic nitrogen compounds. The petroleum crude oil or fraction thereof possessing a reduced quantity of heterocyclic nitrogen compounds is hydrotreated in the presence of hydrogen and a hydrotreating catalyst to further remove the basic heterocyclic nitrogen compounds. The extractant stream is treated in an extractant separation zone to renovate the extractant for recycle to the two-phase extractant zone, substantially free of removed basic heterocyclic nitrogen compounds.

26 Claims, 1 Drawing Sheet

TWO-STEP HETEROCYCLIC NITROGEN EXTRACTION FROM PETROLEUM OILS

FIELD OF THE INVENTION

The field of this invention resides in the removal of nitrogen compounds from fossil fuels inclusive of petroleum oils. This invention seeks to vitiate problems of nitrogen content indigenous in petroleum oils such as those derived on the West Coast of the United States and in particular in the Los Angeles basin. These nefarious nitrogen compounds create a major problem in dowstream processing of the crude oil by forming heterocyclic nitrogen compounds and amine compounds which act as a degradation agent for many of the metals used in the reactors and certain distillation units which are necessary to acquire the various substrates from the petroleum distillates. The nitrogen compounds are also known to be strong poisons for many catalysts used in refineries. Various prior methods have been employed for separating nitrogen compounds from crude oil such as the use of gaseous sulfur dioxide and the use of inorganic acid agents.

This invention seeks to eliminate uniphase treatment of a petroleum oil to concentrate and extract the nitrogen compounds. While it is not possible to feasibly remove all nitrogen compounds from petroleum oils, it is highly desirous that the content of the nitrogen compounds be reduced to a feasible minimum to reduce the poisoning of the catalyst in downstream processing and to mitigate hydrotreating of lubricants, fuel oils, etc., before their eventual end use. This unique two-step process first excises the heterocyclic nitrogen compounds via extraction with a lower aliphatic carboxylic acid or a mixture thereof and second hydrotreats the recovered petroleum oil to further lower nitrogen content. If desirable, the feedstream to the extraction unit can undergo pre-extraction distillation to arrive at a bottoms stream having an increased concentration of basic nitrogen compounds while the overhead stream may not necessitate processing by the process this invention.

Current practice for excising these nitrogen compounds resides in hydrorefining a petroleum oil in the presence of hydrogen and a catalyst at high severities of temperature and pressure. This technique seeks to actually convert the nitrogen compounds to less troublesome nitrogen components which can be removed in downstream processing. This technique also results in a great economic disincentive to convert a nefarious compound to another less troublesome compound.

The field of this invention resides in a two-step nitrogen reduction process consisting of a first step of basic nitrogen extraction wherein the basic nitrogen concentration of the original feed is reduced by extraction with a carboxylic acid extractant followed by hydrotreating to remove the basic nitrogen compounds of the recovered petroleum oil. This will result in an overall savings in total hydrogen consumption of the hyrorefining process. This reduction is substantial because certain basic nitrogen compounds consume a large amount of hydrogen to thereby eliminate them. The hydrotreating will be performed under less severe hydrotreating conditions as a result of the presence of a small concentration of basic nitrogen compound in the extraction zone raffinate stream. Use of this process will permit the convenient refining of many high basic nitrogen crude oil streams and fractions which, at best, were very costly to convert to more useful hydrocarbon.

BACKGROUND OF THE INVENTION

In addition to the hydrorefining state-of-the-art practiced in the presence of a hydrorefining catalyst, hydrogen and high temperatures and pressures, other techniques have been disclosed for the removal of these nitrogen compounds. Recently, two U.S. Pat. Nos. 4,332,676 and 4,332,675 issued to Baset, which disclose a process for the removal of basic nitrogen compounds from organic streams inclusive of petroleum oils utilizing gaseous sulfur dioxide to thereby precipitate a salt comprising the basic nitrogen compound, sulphur dioxide and water with downstream separation of the precipitated salt. Both of these patents concern a single-phase treatment system with the content of water in the separation system in '675 being substantially eliminated and the quantity of water in '675 being such that only a single phase system is existent. In fact, in the latter reference the addition of water is limited to a concentration only to the extent that a two-phase liquid system will never be formed. It is also disclosed that a non-polar solvent can be utilized in the contacting step such as a petroleum ether, a lower paraffinic hydrocarbon or an aromatic hydrocarbon such as toluene. While the types of basic organic nitrogen compounds extracted in the instant invention are either similar to or the same as those described in column 2 of the '676 disclosure, the means by which the process is undertaken in the instant invention is very different from that disclosure.

In the October 1983 issue of *Chemical Engineering* an article by Desai and Madgavkar, recognizes a method to remove catalyst-poisoning nitrogen compounds from shale oil by solvent extraction with a formic acid/water solvent prior to hydrotreating. The advantage of this technique is a lowering of the hydrogen consumption and a reduction of the nitrogen content to a tolerable level feasible for downstream processing of the shale oil. It should be noted that the nitrogen compounds indigenous to the shale oil are unique and will not necessarily behave in the same manner as the nitrogen compounds indigenous to petroleum oils. Further, shale oil liquids are derived from a polymeric material, "kerogen", which is thermally decomposed into liquids which contain the nitrogen molecules. Petroleum oils are formed by biological and chemical action of nature over a much longer period of time, are more mature than shale-derived oils and have a chemical constituency far different from shale-derived oils. Also, the starting materials in formulation of the petroleum oil versus the shale oil are very different and produce a lower and different content of nitrogen compounds for the petroleum oil than the shale oil. The method of nitrogen extraction in regard to the latter can simply not be extrapolated to the former.

The addition of inorganic acids to petroleum oils to reduce the quantity of nitrogen compounds has long been established. For example, in U.S. Pat. No. 2,352,236 anhydrous hydrogen chloride is added to improve a charge stock for catalytic cracking. A dilute acid, such as sulfuric acid, is disclosed in U.S. Pat. No. 1,686,136 to complex nitrogen compounds existent in a California-derived crude oil. Organic carboxylic acids, sometimes referred to as low molecular weight fatty acids of high volatility, have been used to complex nitrogen-bases in such disclosures as U.S. Pat. Nos. 2,263,175 and 2,263,176. While these latter two references employ a portion of the chemical mechanism utilized in the first step of this two-step nitrogen extraction process, they fail to disclose, suggest or even hint at the use of a second step to hydrotreat the recovered petroleum oil fraction to more precisely lower the content of the heterocyclic nitrogen compounds. Also, these references fail to teach the use of a combination carboxylic acid extraction step with such acids as an admixture of formic and acetic acids. This is important in light of the cross production of an acetic acid, i.e., formic acid will usually be present as an impurity. Thus, it may be economic and advantageous to use a mixture of such co-produced carboxylic acids as the extractant of the first extraction step.

A patent issued to Johnson et al, U.S. Pat. No. 4,409,092 in 1983, teaches formation of a high nitrogen fraction and a low nitrogen fraction, which is then subjected to phosphoric acid extraction. The fraction high in nitrogen content is catalytically cracked and then either hydrotreated or sent to phosphoric acid extraction. There is no disclosure by Johnson et al of a process whereby extraction of a petroleum oil is made in the presence of a $C_1$ to $C_{15}$ carboxylic acid extraction agent and then subsequent hydrotreatment. The patent teaches at column 14 that use of acetic acid is not desirable since such use would result in esterification of the materials being treated.

A shale oil feedstock is treated in a patent issued to Kuk et al, U.S. Pat. No. 4,483,763 in 1984. This is not a petroleum crude oil process and the nitrogen components indigenous to the shale oil are different from the nitrogen compounds of petroleum oil as taught by above-discussed Johnson et al (see column 1, line 35+). Kuk et al hydrotreat prior to division into a nitrogen lean and a nitrogen rich stream. After a hydrotreating step, which is necessary to eliminate the more easily hydrogenatable components, the intractable nitrogen components are then subject to solvent extraction. The extractant component utilized in Kuk et al is an organic polar solvent such as an alkanol. This is an active and mandatory ingredient in the Kuk et al extraction as demonstrated by Examples 8–10 (col. 5) where no carboxylic acid is present yet a reduction in nitrogen content is realized. The specific example of this reference discloses that the feed material contains 2.05 percent nitrogen. The segregated middle distillate cut contains only 0.53 percent nitrogen (a smaller amount of nitrogen compounds), which is subjected to solvent extraction.

OBJECTS AND EMBODIMENTS

An object of this invention is to provide a process for the extraction of heterocyclic nitrogen compounds from a petroleum oil by means of a two-step process.

Another object of this invention is to provide a process for extracting basic heterocyclic nitrogen compounds from a petroleum oil or a fraction thereof, such as a vacuum gas oil, by means of first extracting the petroleum oil with a extractant comprising a carboxylic acid wherein the petroleum oil recovered after extraction is subjected to hydrotreating.

Another object of this invention is to provide for an extraction process whereby if residuum extractant is complexed with the petroleum oil, the damage to downstream hydrotreating catalyst is mitigated.

Another object of this invention is to provide a process for the convenient two-step removal of basic heterocyclic nitrogen compounds by first extracting with an extraction agent to remove hard to treat heterocyclic nitrogen compounds and subsequently hydrotreating to further reduce the content of the heterocyclic nitrogen content.

In one aspect, an embodiment of this invention resides in a process for the removal of basic heterocyclic nitrogen compounds from a petroleum crude oil which comprises treating a petroleum crude oil rich in basic heterocyclic nitrogen compounds in a two-phase separation zone comprising an extractant consisting essentially of an aqueous solution of a lower carboxylic acid, at separation conditions, to complex said basic heterocyclic nitrogen compounds with said lower carboxylic acid and thereby remove at least a portion of said basic heterocyclic nitrogen compounds from said petroleum crude oil and to form a first separation stream comprising a petroleum crude oil with a lean content of basic heterocyclic nitrogen compounds and a second separation stream comprising an aqueous phase containing said lower carboxylic acid and having an increased content of basic heterocyclic nitrogen compounds, passing said first separation stream to a catalytic hydrotreatment zone to hydrotreat said petroleum crude oil in the presence of hydrogen and a catalytic composition of matter, at hydrotreatment conditions, to remove basic heterocyclic nitrogen compounds, and recovering a hydrotreated petroleum crude oil stream having a lower content of basic heterocyclic nitrogen compounds than present in said first separation stream having a lean content of basic heterocyclic nitrogen compounds.

Another embodiment resides in a process for removing heterocyclic nitrogen compounds from a petroleum crude oil or fraction thereof in a two-step process wherein said first step comprises a two-phase separation zone, said process comprising passing a petroleum crude oil or fraction thereof containing said heterocyclic nitrogen compounds to a two-phase separation zone having mixing means and, an addition means for the addition to said two-phase separation zone of an aqueous extractant agent comprising a carboxylic acid having from 1 to 15 carbon atoms, wherein a first phase comprises said petroleum oil or fraction thereof having a reduced content of said heterocyclic nitrogen compounds and wherein a second phase comprises water, said carboxylic acid and an increased content of heterocyclic nitrogen compounds compared with the content of heterocyclic nitrogen compounds present in said extraction agent added to said two-phase separation zone through said addition means; removing said first phase comprising said petroleum oil or fraction thereof from said two-phase separation zone and passing said petroleum oil or fraction thereof to a hydrotreatment zone, to hydrotreat said petroleum oil or fraction thereof, at hydrotreatment conditions, in the presence of a catalyst and hydrogen to remove heterocyclic nitrogen compounds; removing from said two-phase separation zone said second phase and passing said second phase to a second separation zone to separate said second phase into a stream having a rich content of heterocyclic nitrogen compounds and an extractant recycle stream comprising water and said $C_1$ to $C_{15}$ carboxylic acid; and recycling said extractant recycle stream to said two-phase separation zone through said addition means.

BRIEF DESCRIPTION OF THE INVENTION

In this invention a two-step heterocyclic nitrogen removal process functions on a crude oil or fraction thereof to excise heterocyclic nitrogen compounds therefrom. The first step entails extraction with a lower carboxylic acid to remove difficult to excise heterocyclic nitrogen compounds. The second step concerns hydrotreatment in the presence of hydrogen and a catalyst to further remove the undesirable heterocyclic nitrogen compounds.

DETAILED DESCRIPTION OF THE INVENTION

The present invention is not concerned with how the petroleum oil is derived having the basic nitrogen compounds contained therein. The various fossil fuels may be either those naturally derived from geological sources or those previously treated to modify the molecular structure of same. Thus, instant crude oils from such fields in Mexico, California and Texas, which are very high in nitrogen compounds, are clearly contemplated to be within the scope of this invention. Also, gas oils and other refinery streams such as fluid catalytic cracking feed material, coker gas oils, vacuum distillate oils, etc., are contemplated to be within the confines of this invention. If desired, the petroleum oil may be distilled or fractionated in a separation zone prior to extraction to concentrate the problem causing nitrogen compounds into a select special stream, i.e., a distillate bottoms stream. In this manner, a refiner may quickly arrive at a processable stream and concentrate all of the nefarious nitrogen-containing compounds into a segregated portion of the refinery.

The extraction agent utilized in the first step of this two-step extraction-hydrotreating process is commonly referred to as a complexing or extraction agent and comprises an aliphatic organic carboxylic acid. It is preferred that these carboxylic acids be limited to 1 to 15 carbon atoms such as exemplified by formic acid, acetic acid, propionic acid, n-butyric acid, isobutyric acid, valeric acid, trimethylacetic acid, caproic acid, n-heptylic acid, caprylic acid, pelargonic acid, nonanoic acid, decanoic acid, undecanoic acid, dodecanoic acid, tridecanoic acid, tetradecanoic acid, pentadecanoic acid, etc. It is preferred that the aliphatic carboxylic acid be present in admixture with another aliphatic carboxylic acids. In this manner the neat production product of acetic acid, which usually contains some formic acid, can be used directly as the extraction agent without any purification step. It is also contemplated that the $C_1$ to $C_{15}$ aliphatic carboxylic acid be substituted by a moiety chosen from the halogen group of the Periodic Table. Such halogen moieties are one or more of fluoro-, chloro-, bromo-, and iodo-moieties. Exemplary of these substituted carboxylic acids are fluoroacetic acid, chloroacetic acid, bromoacetic acid, iodoacetic acid, dichloroacetic acid, trichloroacetic acid, alpha-chloropropionic acid, beta-chloropropionic acid, etc.

The aliphatic carboxylic acids having from 1 to 15 carbon atoms or the $C_1$ to $C_{15}$ halo-substituted carboxylic acids may be present conjunctly with an inert cosolvent. This cosolvent is described as being inert in character in that it does not function as a complexing agent for the heterocyclic basic nitrogen compound. It is necessary in some cases to have this cosolvent present to facilitate intimate phase contact between the two-phase system of the petroleum oil and the aqueous phase containing the aliphatic carboxylic acid. These cosolvents can be considered a mixing means or as an aid to a mixing means. Examples of such inert cosolvents comprise $C_5$ to $C_{10}$ paraffins such as pentane, hexane, heptane, octane, nonane and decane; $C_1$ to $C_{10}$ alkanols such as methanol, ethanol, butanol, propanol, pentanol, hexanol, heptanol, octanol, nonanol, decanol, and a naphtha solvent boiling in the range of 120° F. to about 450° F. or even any admixture of the respective cosolvents.

The quantity of $C_{1-15}$ aliphatic carboxylic acids necessary to complex the heterocyclic basic nitrogen compounds is dependent on the quantity of heterocyclic basic nitrogen compounds existent in the petroleum oil feedstock which is to be treated via the extraction agent. In the practice of this invention, it is preferred that at least one mole of carboxylic acid be present for each mole of heterocyclic basic nitrogen compound present in the petroleum oil. Most preferably, 1.5 mols of carboxylic acid per mole of the heterocyclic basic nitrogen compound will be present in the extraction zone having two phases contained therein. It is of course possible that a larger amount of the carboxylic acid can be utilized than is necessary to adequately complex the heterocyclic basic nitrogen compounds, however, when an over stoichiometric amount of carboxylic acid is utilized, an undesirable hardship is realized in the downstream separation of the aqueous carboxylic acid phase from the enhanced petroleum oil fraction having an elevated content of heterocyclic basic nitrogen compounds.

The first process step of this invention concerns a two-phase system for complexing or extracting the heterocyclic basic nitrogen compounds. One phase is of course the petroleum oil containing the nefarious heterocyclic basic nitrogen compounds while the second phase is an aqueous phase having a $C_{1-15}$ aliphatic carboxylic acid-complexing agent dissolved therein. The quantity of water in the liquid phase must be sufficient to insure creation and maintenance of a two-phase system. It is preferred that the quantity of water be maintained at least to a degree to be a viable solvent for the $C_{1-15}$ aliphatic carboxylic acid in the liquid phase. The concentration of the carboxylic acids in the aqueous phase will be from about 20 to about 95 weight percent.

The amount and type of heterocyclic basic nitrogen compounds is easily ascertained by a chemical analysis of a fungible sample of the applicable petroleum oil or fraction of the petroleum oil. While not wishing to be bound by any specific heterocyclic basic nitrogen compound, it is believed that most prevalent nitrogen compounds in petroleum oils include at least one of azetidines, azoles, aziridines, pyridines, pyrollidines, benzimidazoles, 1,3-benzisodiazoles, 1,2-benzisoxazines, benzofurans, pyrimidines, quinolines, quinoxalines, 1,2,3,4-tetrazoles, pyridazines, piperazines, piperdines, petazines, tetrahydroquinolines, phenthridines.

The extraction conditions utilized in the two-phase system include a temperature of from ambient to 300° F., and a pressure of from 1 atmosphere to 20 atmospheres. A preferred range of extraction conditions includes a temperature of from about 90° F. to about 180° F., and a pressure of from about 2 atmospheres to about 10 atmospheres. A most preferred range of extraction conditions includes a temperature of from about 100° F. to about 140° F., and a pressure of from about 2 atmospheres to about 3 atmospheres. The extraction section utilized in this invention can be any conventional solvent extraction equipment which provides a mixing means for adequate intermixture of the two-phase system. Such mixer settlers or columns are commonplace in the art and are exemplified by such apparatus as a rotating disc contactor, a pulsating column, or the like. Addition means are also provided for the entry of the extractant to the extraction zone. This means can comprise any type of valve or conduit necessary to provide ready access to the interior of the extraction zone. The addition means can be constructed to pass new extractant, new and recycle extractant, or only recycle extractant, to the extraction zone.

It is also contemplated that more than one stage of contacting may be used and that the extractions may be repeated to continuously provide a petroleum oil effluent with smaller quantities of the heterocyclic basic nitrogen compounds. It is preferred that the extraction is carried out at sufficiently high temperatures to facilitate intimate mixing of both phases and that, if desired, at least one of the above cosolvent can be present to give better mixture of the components.

After extraction, the petroleum oil stream is withdrawn from the extraction zone and passed to a catalytic-hydrotreatment step to remove further heterocyclic nitrogen components. If desirable, this stream may be preheated to a temperature in excess of 400° F. to in excess of 700° F. and distilled previous to hydrotreating. Regardless of the distillation step, the petroleum oil is subjected to catalytic hydrotreatment. It is preferred that this hydrotreatment be conducted under conditions considered mild, inclusive of a temperature of from about 600° F. to about 800° F., a pressure of about 25 atmospheres to about 150 atmospheres and a liquid hourly space velocity of from about 0.5 to 5. The hydrotreating is performed in the presence of hydrogen and a hydrotreating catalyst which can comprise a refractory, inorganic oxide support having deposited thereon various metals of the Periodic Table selected from Group VII and/or Group VIB of the Periodic Table. Specific examples of these hydrotreating catalysts include a platinum catalyst modified with molybdenum or a nickel catalyst modified with tungsten. The actual weight percent of these metals necessary to perform hydrotreating is clearly within the confines of those of reasonable skill in the art and need not be exemplified any further herein.

If desirable, an intermediate distillation step can be performed to enhance the quantity of nitrogen components being passed to the hydrotreating zone. This enhancement step usually will comprise a distillation of the petroleum oil stream withdrawn from the extraction zone where the top temperature of the distillation is maintained at a temperature of from about 200° F. to about 700° F. and a bottom temperature of about 500° F. to about 1100° F. The temperatures maintained in this distillation zone will be characteristic of the petroleum feed in question and may very substantially, depending on the nitrogen content desired, to be concentrated in the bottoms stream. Normally, when such an embodiment is utilized, the petroleum oil stream will be divided into two steams, one having a deficiency of heterocyclic basic nitrogen compounds, compared to the stream withdrawn from the extraction zone, and the other stream being rich in heterocyclic basic nitrogen compound compared to the heterocyclic basic nitrogen content of the extraction zone effluent. In such an embodiment an extractant recycle stream may be derived from the top of the distillation column and recycled to the extraction zone. In addition a recycle stream may be derived from the downstream hydrotreatment zone and passed back to the extraction step.

A second stream withdrawn from the extraction zone will comprise an aqueous phase comprising an aliphatic carboxylic acid extractant with an increased quantity of heterocyclic nitrogen compounds. This stream is passed to a secondary zone where the aqueous phase with the carboxylic acid is separated, by separation means, from the heterocyclic nitrogen compounds. A waste stream comprising the heterocyclic nitrogen compounds can be discharged in an economically viable manner or can be further processed to remove the mineral oils inherent therewith. The recovered aqueous phase containing the aliphatic carboxylic acid is considered at least partially as a recycle stream which can be re-entered to the two-phase separation step through the addition means previously discussed. The separation conditions undertaken in this second separation zone comprise a temperature of from ambient to 300° F. and a pressure of from 1 atmosphere to about 20 atmospheres. Preferably, the temperature and pressure conditions can be maintained synonymous with those of the extraction conditions which, preferably, is a temperature of 90° F. to 180° F., and most preferably, a temperature of 110° F. to 140° F., with a preferred pressure of 2 to 10 atmospheres, and a most preferred pressure of 2 to 3 atmospheres.

DETAILED DESCRIPTION OF THE DRAWINGS

Figure 1:
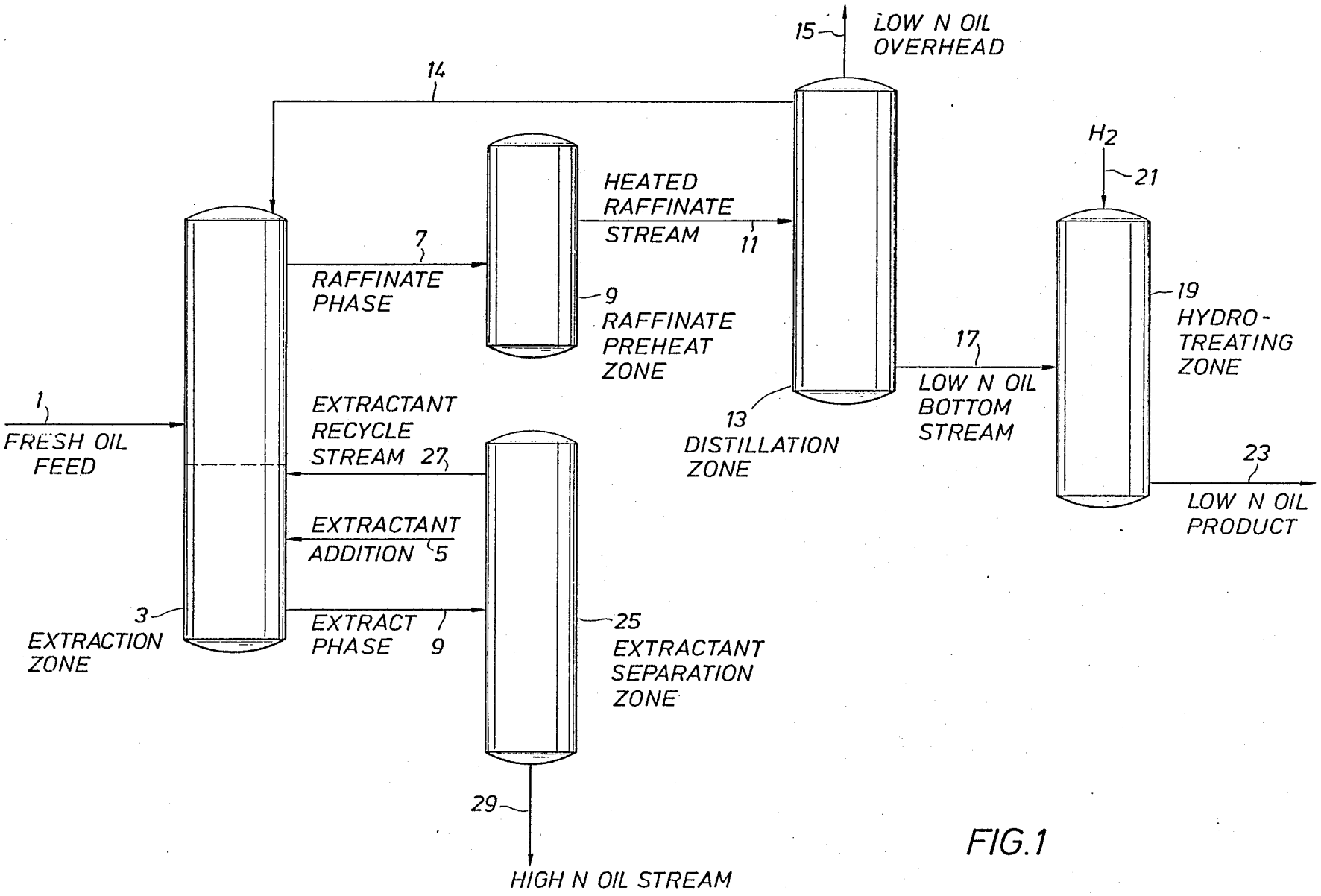
FIG. 1 is a flow scheme of the instant two-step extraction system of this invention where nitrogen compounds are removed in a first step by extraction and then in a second step by hydrotreating.

While not wishing to be bound by any specific flow scheme herein, FIG. 1 is representative of one of the preferred embodiments of this invention. Fresh petroleum oil or a fraction thereof having a high content of nitrogen compounds is added through conduit 1 to two-phase extraction zone 3. If desirable, fresh oil feed in conduit 1 may be heated in a heating zone (not shown) previous to addition to extraction zone 3. If desired, a distillation step may be performed on the fresh oil feed and only a portion passed to extraction containing a concentration quantity of nitrogen-containing compounds. In extraction zone 3 two phases are formed. A first phase comprises a petroleum oil from which heterocyclic nitrogen compounds have been extracted by means of a $C_1$ to $C_{15}$ carboxylic acid extraction agent. New extractant comprising $C_1$ to $C_{15}$ lower carboxylic acid is added to extraction zone 3 through addition means 5. Two phases formed in the extraction zone 3 are removed as raffinate stream 7 and extract phase 9. Each is treated differently, derivative of their makeup. Raffinate phase 7 contains petroleum oil having a reduced quantity of heterocyclic nitrogen compounds compared to the fresh feed oil. The raffinate phase is passed to a raffinate preheat zone 9 where the temperature of the raffinate phase is raised to 300° F. to 900° F. Withdrawn from raffinate preheat zone 9 is a heated raffinate stream 11 which is then fed to an optional separatory step 13, usually comprised of a distillation unit. The distillation unit has a temperature profile dependent on the content of the fresh oil feed. Usually the temperature in overhead 15 of distillation zone 13 is between 200° F. and 700° F. The bottom temperature of distillation zone 13 is between 500° F. and 1100° F. There are also provisions made for the recirculation of an overhead reflux stream or a bottoms recycle stream which is heated by indirect heat exchange to maintain a constant heat profile in the distillation column. A recycle stream 14 may be withdrawn from distillation zone 13 and passed back to extraction zone 3 to increase the content of extractant free of nitrogen-containing compounds. A stream low in nitrogen content is withdrawn as a petroleum oil in overhead stream 15 which may be further processed via hydrotreating or may be utilized in downstream processing such as catalytic conversion to gasoline.

A stream high in nitrogen content comprising a petroleum oil is withdrawn from distillation zone 13 in conduit 17 and passed to hydrotreating zone 19. The concentration of heterocyclic nitrogen compounds in distillation bottoms stream 17 is high relative to the nitrogen content in heated raffinate stream 11 but still low compared to the nitrogen content of fresh oil feed 1, which has undergone carboxylic acid extraction. The temperature conditions in hydrotreating zone 19 comprise a temperature of between 600° F. to about 850° F., a pressure of about 25 atmospheres to about 150 atmospheres, and a liquid hourly space velocity of from about 0.5 to about 5. The hydrotreating takes place in the presence of a hydrotreating catalyst (not shown) in hydrotreater 19 and in the presence of hydrogen independently added via conduit 21. After hydrotreating is performed, a product stream low in nitrogen content comprising a petroleum oil is withdraw from hydrotreater 19 by means of conduit 23. This stream is passed to further processing, such as catalytic cracking, or is admixed with stream 15 and both streams then passed to subsequent hydroprocessing.

An extract phase containing the carboxylic acid, water, and increased heterocyclic nitrogen components is withdrawn from extraction zone 3 by means of extract phase conduit 10. This stream is passed to secondary extract separation zone 25 maintained at conditions including a temperature of from about 100° F. to about 600° F. and a pressure of from about 10 mm of HG to about 2 atmospheres. The actual temperature and pressure values will, however, depend on several factors including the characteristics and amounts of the extractant, oil, purify of extractant, and percent recovery of the extractant desired, etc. This separation means can comprise a distillation unit or other type of separatory systems whereby a relatively pure extract recycle stream is withdrawn from the top of the extraction zone in conduit 27 and at least a portion passed to extraction zone 3. It is within the confines of this invention that extract recycle conduit 27 and extractant addition means 5 are contained in a manifold. A stream of very high nitrogen content comprising a petroleum oil is withdrawn in conduit 29 and is properly disposed of or is passed to further processing to recapture the mineral content of the petroleum oil.

ILLUSTRATIVE EMBODIMENTS

The illustrative embodiments described herein are exemplary of this process and are not given to have a limiting effect upon the claims hereinafter presented. While these examples were performed on a batch scale method, one of even modicum skill in the art will readily realize the extrapolation of these tests to the flow scheme as above-described in FIG. 1.

In each of Examples 1 through 3, a vacuum gas oil with the following properties was treated with the described carboxylic acid.

TABLE I

| VACUUM GAS OIL | | |
|---|---|---|
| Sulfur | 1.1 | wt % |
| Total nitrogen | .45 | wt % |
| Basic nitrogen content | 1658 | ppm |
| Ni | 1.63 | ppm |
| V | 0.35 | ppm |
| API gravity | 15.0 | degrees |
| H | 11.35 | wt % |
| C | 86.43 | wt % |
| O | 0.64 | wt % |
| Boiling Point | | |
| IBP | 472° | F. |
| 25% | 709° | F. |
| 50% | 816° | F. |
| 75% | 914° | F. |
| Final BP | 1124° | F. |

EXAMPLE 1

In this example 50 gms of a sample of the vacuum gas oil of Table I were shaken for about 15 minutes at ambient temperature with 50 gms of a water solution containing approximately 70 percent acetic acid. Two phases were allowed to separate at about 113° F. to about 122° F. for approximately 15 minutes. The phases were separated and the oil phase thereafter analyzed for its quantity of basic nitrogen compounds. The basic nitrogen content was reduced to 1228 ppm representing a 26 percent decrease from the nitrogen value of the vacuum gas oil. Very little sulfur, nickel or vanadium were removed from the vacuum gas oil.

EXAMPLE 2

In this example 50 gms of the vacuum gas oil were shaken for about 15 minutes at room temperature with 50 gms of a water solution containing approximately 90 percent acetic acid. The two phases were allowed to separate at room temperature for about 15 minutes. The phases were separated and the oil phase analyzed. The basic nitrogen content was reduced to 611 ppm representing a 63 percent decrease from the 1658 ppm basic nitrogen in the vacuum gas oil. Again, very little sulfur, nickel or vanadium were removed from the vacuum gas oil.

EXAMPLE 3

In this example, 3 kilograms of the vacuum gas oil were stirred with about 3 kilograms of an approximately 70 percent acetic acid solution in water. A motor-driven stir means with an impleller was used to stir the mixture for two to three hours. The phases were allowed to separate over a period of about 12 hours and the oil phase analyzed. The oil phase contained about 890 ppm basic nitrogen representing a decrease of about 46 percent from the 1658 ppm basic nitrogen content of the vacuum gas oil.

EXAMPLE 4

This example is exemplary of the hydrotreating contemplated on the oil phases recovered with a diminished basic nitrogen content, i.e. Examples 1, 2, and 3. This hydrotreating can be affected in the presence of a hydrotreating catalyst comprising nickel and molybdenum on alumina. The hydrotreating can be affected at conditions including a temperature of 600° F. to 800° F. and a pressure of 1 to 100 atmospheres to acquire a hydrotreated product. If desired, distillation upstream of this hydrotreating step can be effected to form a concentrated nitrogen content in a bottoms stream from a distillation zone for subsequent hydrotreating. The basic nitrogen content of the oil phase recovered after hydrotreating with both the embodiment of the intermittent preheating and distillation, and without such embodiments, contains a small quantity of heterocyclic nitrogen compounds.

What we claim as our invention is:

1. A process for the removal of heterocyclic nitrogen compounds from a petroleum crude oil which comprises treating a petroleum crude oil rich in basic heterocyclic nitrogen compounds in a two-phase extraction zone comprising an extractant consisting essentially of an aqueous solution of a lower carboxylic acid in a concentration of from about 20 up to 95 weight percent in said aqueous phase, at separation conditions, to extract at extraction conditions said basic heterocyclic nitrogen compounds with said lower carboxylic acid and thereby remove at least a portion of said basic heterocyclic nitrogen compounds from said petroleum crude oil and to form a first extraction stream comprising a petroleum crude oil with a lean content of basic heterocyclic nitrogen compounds and a second extraction stream comprising an aqueous phase containing said lower carboxylic acid and having an increased content of basic heterocyclic nitrogen compounds, passing said first separation stream to a catalytic hydrotreatment zone to hydrotreat said petroleum crude oil in the presence of hydrogen and a catalytic composition of matter, at hydrotreatment conditions, to remove basic heterocyclic nitrogen compounds and recovering a hydrotreated petroleum crude oil stream having a lower content of basic heterocyclic nitrogen compounds than present in said first separation stream having a lean content of basic heterocyclic nitrogen compounds.

2. The process of claim 1 wherein said second extraction stream is treated in an aqueous extractant separation zone wherein two phases are formed comprising a first aqueous extractant stream comprising water and a lower carboxylic acid and a first rich basic heterocyclic nitrogen and petroleum oil extractant stream, at separation conditions, and wherein said first aqueous extractant stream and said first rich heterocyclic nitrogen and petroleum oil extractant stream are removed from said aqueous extractant separation zone.

3. The process of claim 2 wherein said first aqueous extractant stream is passed to said two-phase extraction zone as an aqueous extractant recycle streamm containing said lower carboxylic acid extractant.

4. The process of claim 1 wherein said petroleum crude oil is a crude oil fraction.

5. The process of claim 4 wherein said crude oil fraction is a vacuum gas oil or a coker gas oil.

6. The process of claim 1 wherein said extractant consisting essentially of a lower carboxylic acid is an aliphatic carboxylic acid having from 1 to 15 carbon atoms.

7. The process of claim 6 wherein said aliphatic carboxylic acid comprises a mixture of two or more aliphatic carboxylic acids.

8. The process of claim 6 wherein said aliphatic carboxylic acid is selected from the group consisting of acetic acid, oxalic acid, formic acid, propionic acid, n-butyric acid and mixtures thereof.

9. The process of claim 1 wherein said extractant agent is present with an inert cosolvent selected from the group consisting of a paraffinic hydrocarbon having from 5 to 10 carbon atoms, an alkanol having from 1 to 10 carbon atoms and a naphtha having a boiling point of from 180° F. to 450° F.

10. The process of claim 6 wherein said aliphatic carboxylic acid is substituted with a halo moiety selected from the group consisting of chloro-, fluoro-, bromo- and iodo-moieties.

11. The process of claim 10 wherein said halo-substituted carboxylic acid is chloroacetic acid.

12. The process of claim 10 wherein said halo-substituted carboxylic acid is trifluoroacetic acid.

13. The process of claim 1 wherein said extraction conditions comprise a temperature of from ambient to 300° F. and a pressure of from 1 atmosphere to about 20 atmospheres.

14. The process of claim 1 wherein said extraction conditions comprise a temperature of from 90° F. to about 180° F. and a pressure of from 2 to 10 atmospheres.

15. The process of claim 1 wherein said extraction conditions comprise a temperature of from 100° F. to 140° F. and a pressure of from about 2 to 3 atmospheres.

16. The process of claim 1 wherein said hydrotreatment conditions comprise a temperature of from 600° F. to about 850° F., a pressure of from about 25 atmospheres to about 150 atmospheres and liquid hourly space velocity of from about 0.5 to 5.0 per hour.

17. A process for removing heterocyclic nitrogen compounds from a petroleum crude oil or fraction thereof in a two-step process wherein said first step comprises a two-phase extraction zone, said process comprising:

(a) passing a petroleum crude oil or fraction thereof containing said heterocyclic nitrogen compounds to a two-phase extraction zone having a mixing means and an addition means for the addition to said two-phase extraction zone of an aqueous extractant agent consisting essentially of a carboxylic acid having from 1 to 15 carbon atoms in a concentration of from about 20 up to 95 weight percent in said aqueous phase to form a first phase comprising said petroleum oil or fraction thereof having a reduced content of said heterocyclic nitrogen compounds and to form a second phase comprising water, said carboxylic acid and an increased content of heterocyclic nitrogen compounds compared with the content of heterocyclic nitrogen compounds present in said extractant agent added to said two-phase extraction zone through said addition means;

(b) removing said first phase comprising said petroleum oil or fraction thereof from said two-phase extraction zone and passing said petroleum oil to a hydrotreatment zone, to hydrotreat said petroleum oil or fraction thereof, at hydrotreatment conditions, in the presence of a hydrotreating catalyst and hydrogen to remove heterocyclic nitrogen compounds;

(c) removing from said two-phase extraction zone said second phase and passing said second phase to a separation zone to separate said second phase into a stream having a rich content of heterocyclic nitrogen compounds and an extractant recycle stream consisting essentially of water and said $C_1$ to $C_{15}$ carboxylic acid; and (d) recycling said extractant recycle stream to said two-phase extraction zone through said addition means.

18. The process of claim 17 wherein said mixing means comprises a pulsating column disc contactor.

19. The process of claim 17 wherein mixing means comprises a rotating disc contactor.

20. The process of claim 17 wherein said hydrotreating catalyst comprises a metal of Group VIII, a metal of Group VIB or combinations thereof supported on an inorganic oxide support.

21. The process of claim 17 wherein said $C_1$ to $C_{15}$ aliphatic carboxylic acid is substituted with at least one moiety selected from the group consisting of a chloro-, bromo-, fluoro- and iodo-moieties.

22. The process of claim 17 wherein said carboxylic acid extractant is present in combination with an inert cosolvent selected from the group consisting of a $C_5$ to $C_{10}$ paraffinic hydrocarbon, a $C_1$ to $C_{10}$ alkanol and a naphtha having a boiling point of from 180° F. to 450° F.

23. The process of claim 17 wherein said petroleum oil stream recovered from said two-phase extraction zone is heated to a temperature of from 400° F. to about 700° F. before passage to said hydrotreatment.

24. The process of claim 17 wherein said first phase removed from said extraction zone is passed to a distillation zone to distill said first phase into an overhead distillation zone effluent stream and a bottoms distillation zone effluent stream and wherein said bottoms distillation zone effluent stream is passed, as said petroleum oil, to said hydrotreatment zone.

25. The process of claim 24 wherein at least a portion of said overhead distillation zone effluent stream is recycled to said two-phase extraction zone.

26. The process of claim 17 wherein said heterocyclic compound is a species of nitrogen compounds selected from the genus of nitrogen compounds comprising azetidines, azoles, aziridines, pyridines, pyrollidines, benzimidazoles, 1,3-benzisodiazoles, 1,2-benzisoxiozines, benzofurans, pyrimidines, quinoxalines, 1,3,4-tetrazoles, pyridazines, piperazines, piperidines and pentazines.

* * * * *